US010569313B2

(12) United States Patent
Fickert

(10) Patent No.: US 10,569,313 B2
(45) Date of Patent: Feb. 25, 2020

(54) TREATMENT HEAD AND CONTAINER TREATMENT MACHINE COMPRISING A TREATMENT HEAD

(71) Applicant: KHS GmbH, Dortmund (DE)

(72) Inventor: Hilmar Fickert, Kriftel (DE)

(73) Assignee: KHS GmbH, Dortmund (DE)

( * ) Notice: Subject to any disclaimer, the term of this patent is extended or adjusted under 35 U.S.C. 154(b) by 350 days.

(21) Appl. No.: 15/316,362

(22) PCT Filed: May 13, 2015

(86) PCT No.: PCT/EP2015/060613
§ 371 (c)(1),
(2) Date: Dec. 5, 2016

(87) PCT Pub. No.: WO2015/185338
PCT Pub. Date: Dec. 10, 2015

(65) Prior Publication Data

US 2018/0009012 A1 Jan. 11, 2018

(30) Foreign Application Priority Data

Jun. 4, 2014 (DE) ..... 10 2014 107 878

(51) Int. Cl.
*B08B 9/08* (2006.01)
*B05B 13/06* (2006.01)
*B05B 1/34* (2006.01)

(52) U.S. Cl.
CPC ..... *B08B 9/0813* (2013.01); *B05B 1/3415* (2013.01); *B05B 1/3426* (2013.01); *B05B 13/069* (2013.01); *B05B 13/0627* (2013.01); *B08B 9/0826* (2013.01)

(58) Field of Classification Search
CPC . B05B 13/0627; B05B 13/069; B05B 1/3415; B05B 1/3426; B08B 9/0813; B08B 9/0826
USPC ..... 134/116, 166 R, 167 C, 169 R, 177, 179, 134/186, 21, 23, 24, 36, 56 R, 57 R, 134/58 R; 15/104.12; 239/106, 468
See application file for complete search history.

(56) References Cited

U.S. PATENT DOCUMENTS 3,118,612 A * 1/1964 Abplanalp ..... B05B 1/3431 222/402.24
4,228,129 A * 10/1980 Bruning ..... G01N 31/12 422/556
5,393,502 A * 2/1995 Miller ..... B01F 1/00 239/468
5,419,348 A * 5/1995 Kuta ..... B08B 9/32 134/144
8,216,390 B2 * 7/2012 Kometani ..... B08B 9/00 134/133
8,640,719 B2 * 2/2014 Gmeiner ..... B08B 9/30 134/132

(Continued)

*Primary Examiner* — Nadine G Norton
*Assistant Examiner* — Christopher Remavege
(74) *Attorney, Agent, or Firm* — Occhiuti & Rohlicek LLP

(57) ABSTRACT

A treatment head for cleaning a container that has a valve arrangement that includes a tappet that is configured to move relative to the treatment head's housing to open the valve arrangement and fluid channels leading into the container. A first channel of the fluid channels has an annular fluid channel section and surrounds the second channel. A flow twister is disposed in either the first channel or in a line connected to the first fluid-channel.

19 Claims, 3 Drawing Sheets

(56) References Cited

U.S. PATENT DOCUMENTS 8,967,498 B2 * 3/2015 Egli ..... B05B 1/26
239/490

* cited by examiner

TREATMENT HEAD AND CONTAINER TREATMENT MACHINE COMPRISING A TREATMENT HEAD

RELATED APPLICATIONS

This is the national stage under 35 USC 371 of international application PCT/EP2015/060613, filed on May 13, 2015, which claims the benefit of the Jun. 4, 2014 priority date of German application DE 102014107878.0, the contents of which are herein incorporated by reference.

FIELD OF INVENTION

The invention relates container treatment, and in particular, to cleaning a container.

BACKGROUND

Many drinks are delivered in kegs that have a keg fitting containing a valve arrangement. After the drink has been consumed, it is customary to refill the kegs. Prior to refilling, it is desirable to clean the keg's interior. This cleaning should be carried out quickly, to maximize throughput. However, it should also be carried out thoroughly.

Known ways to improve cleaning efficiency include choosing an appropriate cleaning medium, introducing certain additives, changing the concentrations of the cleaning fluid.

Another way to improve cleaning efficiency is through interval cleaning. In interval cleaning, an insertion probe introduces cleaning medium in cycles or intermittently, with different volume flows.

A disadvantage of known cleaning methods is that different regions of the container's interior are subjected to different levels of cleaning efficiency. One region that is particularly difficult to clean is the region closest to the keg fitting.

SUMMARY

The invention is based in part on a recognition of the benefits of the mechanical effect of the flowing or streaming cleaning medium that arises from exertion of a shear effect on the inner surfaces of the container that is to be cleaned. This shear improves removal of residues on the container's inner surface.

An object of the invention is to provide a treatment head that improves cleaning effect of a container's interior in a region of the valve arrangement.

According to a first embodiment, the invention relates to a treatment head for cleaning containers that have a valve arrangement. The treatment head is configured to engage a treatment head of an upside-down container so that the container has its valve arrangement facing down.

The treatment head comprises a treatment-head housing having a movably held tappet. The tappet opens the valve arrangement of the container. This occurs when an actuator pushes it out of its withdrawn setting and into an advanced position. The tappet can be formed with a stepped free end that interacts with the valve arrangement to open two separated fluid channels or fluid passages in the valve arrangement.

The treatment head has first and second fluid-channels formed therein. The first fluid-channel comprises a fluid channel section that is, at least in sections, annular, and that surrounds or encompasses, at least in sections, the second fluid-channel on the circumferential side.

The first and second fluid-channels can he provided for introducing fluid into the container or removing fluid from the container. The fluid can be gas or liquid.

Depending on the switching of the fluid channels, the first fluid-channel can introduce cleaning fluid into the container and the second fluid-channel can carry out a gas displaced by the incoming cleaning fluid. Conversely, however, it is also possible for the second fluid-channel to introduce the cleaning liquid and for the first fluid-channel to transporting away displaced gas or cleaning liquid.

In the first fluid-channel, or in the fluid line connected to the first fluid-channel, a flow twister creates or promotes a spiral fluid flow. In other words, the first fluid-channel, or the fluid line connected to it, comprises devices that cause a change in the direction of flow of fluid being transported in the fluid channel or fluid line, and that do so in such a way that the fluid flow comprises, in addition to a straight-line flow component, a further flow component running transverse to this straight-line flow component. As a result, a spiral or helical fluid flow or flow swirl comes into existence in the first fluid-channel or a fluid line connected to it.

A decisive advantage of the treatment head is that, as a result of the formation of a spiral or helical fluid flow inside the treatment head, a fluid swirl or fluid rotation occurs with the container arranged, by its head, at the treatment head, i.e. a container that is aligned with its valve arrangement downwards, around the valve arrangement or at a valve cage. This flow swirl, especially in the upper section of the container wall around the valve arrangement, is able to clean much better because of the shear effect produced at the container wall in the region of the valve arrangement or in the region of the valve cage of the valve arrangement. This therefore promotes higher cleaning performance in the areas in the container interior that have thus far been difficult to clean.

According to one exemplary embodiment, the flow twister includes a twist body provided in the first fluid-channel or in the fluid line connected to the first fluid-channel. This twist body preferably comprises fluid channels running obliquely to the flow direction or in spiral form. These promote deflection of the fluid flow.

As an alternative, the twist body can have nozzle-type elements. These nozzle-type elements promote flow swirl or flow twist in the fluid flow. This therefore promotes generation of spiral or helical fluid flow and does so as early as in the region of the introduction of the cleaning fluid to the first fluid-channel.

According to a further embodiment, a contoured fluid-line wall of a fluid line connected to the first fluid-channel forms the flow twister. The contoured fluid line wall can be formed by oblique surfaces, by a spiral surface arranged in the wall region, by at least one pipe piece that is spiral or helical in shape, or by corkscrew-shaped windings. Such a fluid line likewise causes a spiral fluid flow that leads to a flow twist of cleaning fluid inside the container around the valve cage.

In a preferred exemplary embodiment, contouring on the wall of the first fluid-channel forms the flow twister. As a result, the fluid transported in the first fluid-channel can be changed in its flow direction, and in particular in a way that causes a rotating flow twist around the tappet.

Preferably, grooves or oblique surfaces form the wall's contours. These grooves or oblique surfaces run obliquely and/or in spiral form to the flow direction of the fluid in the first fluid-channel, i.e. obliquely or in spiral form to the longitudinal axis of the treatment head. The grooves or oblique surfaces can in this situation be introduced directly into the treatment head housing wall, or a sleeve can be provided in the first fluid-channel, which comprises such oblique or spiral surfaces.

According to a further exemplary embodiment, the flow twister can be formed by an upper tappet-part in contact against the valve arrangement, in which fluid channels are formed that run. obliquely or in spiral form. As an alternative to the fluid channels, it is also possible for nozzles to be provided in the upper tappet-part, by means of which the spiral fluid flow is produced. The use of such an upper tappet-part is advantageous, since, in the first fluid-channel, in the immediate vicinity of the valve arrangement, the flow swirl or spiral fluid flow is produced, such that this flow swirl remains essentially retained due to the shortness of the fluid path, and in the container interior a substantial flow swirl is created, which produces a high shear effect in the region of the valve arrangement or valve cage. This allows for an optimum cleaning effect to be produced.

In a further exemplary embodiment, the introduction of the fluid into the fluid channel takes place off-center in the tangential direction relative to the annular cross-section of the first fluid-channel. In other words, the introduction of the fluid into the first fluid-channel takes place offset in relation to the mid-axis of this first fluid-channel. As a result of the introduction of the cleaning fluid in the tangential direction into the annular fluid channel cross-section, a fluid flow is produced that rotates about the tappet, which leads to an improved cleaning effect in the container interior.

As an alternative or in addition to the offsetting of the introduction of the fluid, the off-center tangential inflow into the first fluid-channel takes place through a deflection section, which is provided in the inflow region of the cleaning fluid into the first fluid-channel. This deflection section may comprise, for example, an oblique surface, by means of which a deflection of the fluid flow takes place in the tangential direction relative to the annular fluid channel cross-section. This in turn causes a fluid flow or flow swirl rotating about the tappet.

All the aforesaid embodiments of a flow twister can be provided individually or in any desired combination with one another at the treatment head.

Preferably, with the arrangement of a container at the treatment head, the first fluid-channel is connected to a first annular fluid passage of the valve arrangement. This annular fluid passage is provided on the circumference side around an insertion probe section, which extends into the container interior. In addition, a central second fluid passage can be provided in the valve arrangement, which is preferably arranged inside the annular first fluid passage. This second fluid passage can be coupled to the second fluid-channel of the treatment head such that a cleaning fluid can be introduced at least at two different inlets or through two different fluid channels into the container interior.

According to a further aspect, the invention relates to a container-treatment machine for the cleaning of containers. The container treatment machine comprises at least one, and preferably a plurality, of treatment heads of the same structural form, arranged on the circumferential side. These treatment heads are configured in accordance with the embodiments described heretofore.

According to a third aspect, the invention relates to a method for the cleaning of containers that comprise valve arrangements, by means of a container treatment machine. The container treatment machine comprises at least one, and preferably a plurality, of treatment heads, wherein at least one first fluid-channel and at least one second fluid-channel are formed in the treatment head. The first fluid-channel comprises at least one annular fluid channel section. The second fluid-channel is circumferentially surrounded by the first fluid-channel at least in some sections. The first and second fluid-channels are provided for the supply and/or discharge of a liquid or gaseous fluid into/out of the container. For the improved cleaning of the container, the fluid supplied to the container via the first fluid-channel is set in motion into a spiral fluid flow or flow swirl by way of a flow twister provided in the first fluid-channel or in the fluid line connected to the first fluid-channel such that, after the entry of the spiral fluid flow into the container that is to be cleaned, a flow swirl is created around the valve arrangement. As a result, due to the improved shear effect of the flow swirl, an optimum cleaning of the inner surface of the container around the valve arrangement can be achieved.

Preferably, the supply of the fluid as a spiral swirled fluid flow takes place via the first fluid-channel into the emptied container arranged headfirst. With the container emptied, the flow swirl in the container interior will not be slowed by fluid present in the container interior. This promotes increased flow speed of the flow swirl, which results in improved cleaning. Due to the headfirst arrangement of the container, and the introduction of the swirled fluid flow directly around the valve arrangement through the annular first fluid passage, the container interior can be reached, and in particular, the container wall area that is difficult to reach, such as the area around the valve arrangement, can be reached. This permits cleaning of the valve arrangement itself.

Preferably, after reaching a defined filling level height in the container, the container is emptied. This is follows by a further flushing step to supply the fluid as a spiral fluid flow via the first fluid-channel. This therefore prevents the incoming fluid flow, which produces the fluid swirl, from being slowed by fluid already present in the container in a way that would dampen motion, thus avoiding the possibility of either no flow swirl or inadequate flow swirl.

Preferably, a supply of fluid takes place via the first fluid-channel and the second fluid-channel at temporally offset intervals. For example, via the second fluid-channel a supply of a cleaning fluid can take place by way of the insertion probe located in the container interior such that a cleaning of the container wall regions opposite the valve arrangement can take place. A discharge of the cleaning fluid from the container interior or an emptying of the container interior can be effected. Next, after switching over the supply to the first fluid-channel, an introduction of the cleaning fluid via the first fluid-channel and the first fluid passage can take place, such that, in the region of the valve arrangement, a flow swirl is produced, and therefore a cleaning of the valve arrangement itself, and, respectively, of the container inner surfaces located around the valve arrangement.

Preferably, at the supply of fluid via the second fluid-channel, a complete emptying of the container takes place via the first fluid-channel. As a result, the situation can be reached in which, at the subsequent supply of the fluid via the first fluid-channel, a fluid supply can be provided into the completely emptied container, which allows for an improved cleaning effect to be achieved due to an unimpeded flow swirl being formed in the container.

As used herein, "containers" refers to barrels or kegs for accommodating and storing of fluid filling products, in particular beverages.

As used herein, "container-treatment machines" include machines with which a container treatment can be carried out, such as filling machines, cleaning machines, etc.

As used herein, "treatment head" means all coupling devices for connecting a container that is to be treated with the treatment machine, and includes, in particular filling heads, cleaning heads, and flushing heads.

As used herein, "spiral or swirl fluid flow" means a fluid flow that, as well as a flow direction component, that comprises a rotational flow direction such that the fluid in the first fluid-channel and/or in the fluid line respectively is conveyed swirled in screw fashion. In other words, the fluid being conveyed is set in rotation when flowing through the fluid line and/or the first fluid-channel respectively, i.e. the fluid comprises, as well as a linear flow direction component, a flow twist about an axis running in the flow direction.

More formally, a flow vector in a cylindrical coordinate system such as that which would be natural to use in the illustrated geometry will in general have a radial, circumferential, and axial component. In spiral, swirl, or helical flow as described herein, the circumferential component of the flow vector is non-zero.

As used herein, "essentially" or "approximately" mean deviations from the respective exact value by ±10%, preferably by ±5%, and/or deviations in the form of changes that are not of significance for the function.

Further embodiments, advantages, and possible applications of the invention are also derived from the following description of exemplary embodiments and from the figures. In this context, all the features described and/or represented as images are in principle the object of the invention, alone or in any desired combination, regardless of their combinations in the claims or references to them. The contents of the claims are also deemed to be constituent parts of the description.

BRIEF DESCRIPTION OF THE DRAWINGS

These and other features of the invention will be apparent from the following detailed description and the accompanying figure, in which.

DETAILED DESCRIPTION

Figure 1:
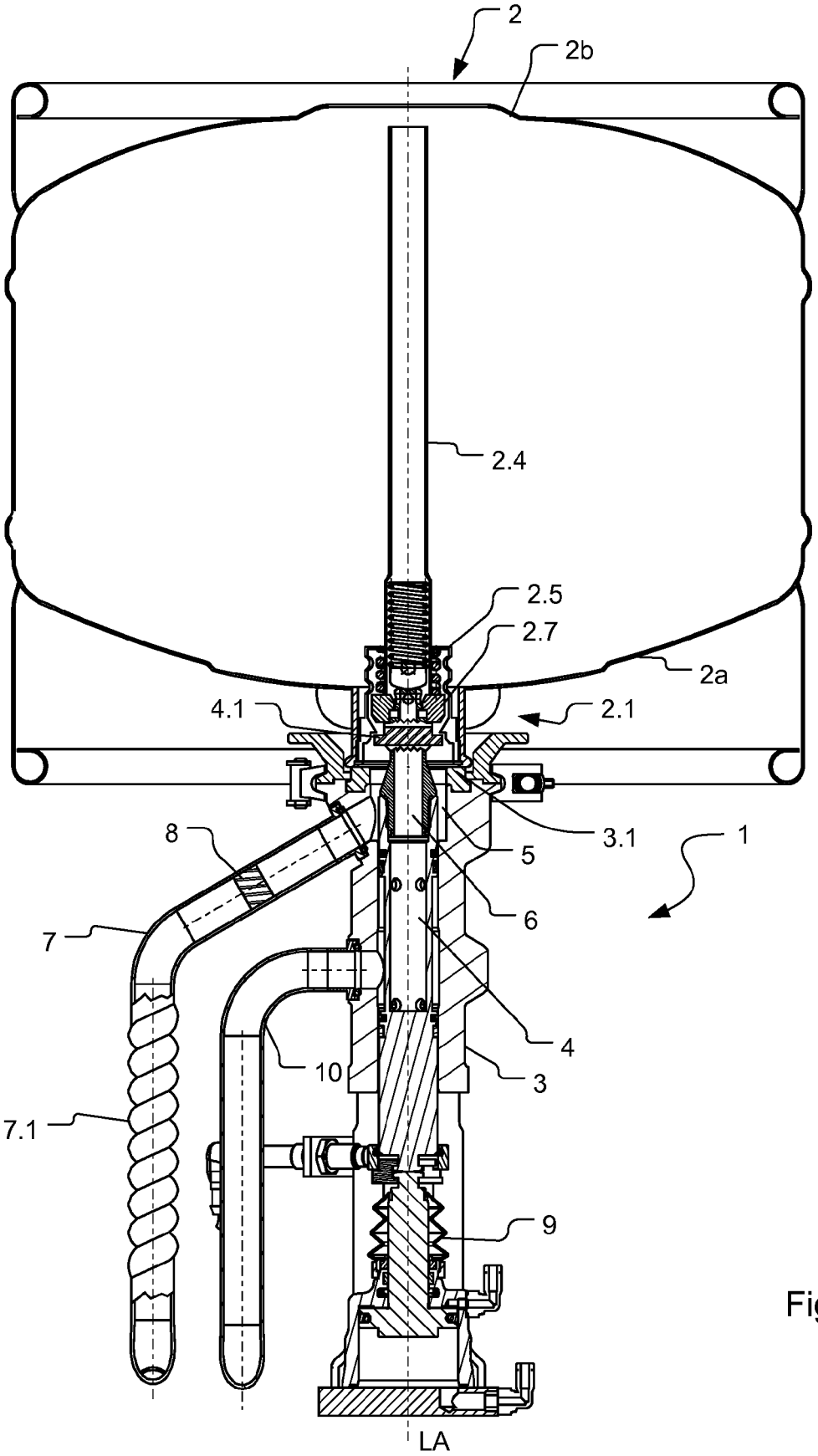
FIG. 1 shows a treatment head according to the invention in contact with a valve arrangement of a container and in an opened position.

FIG. 1 shows a treatment head 1 having a treatment-head housing 3 that extends along a longitudinal axis LA thereof. The treatment-head housing 3 engages a valve arrangement 2.1 of a container 2 via a housing section 3.1. In particular embodiments, the valve arrangement 2.1 is a keg fitting and the container 2 is a keg having an upper container wall section 2*a* that engages the valve arrangement 2.1 and a lower container wall section 2*b* on which the keg typically stands, for example during storage thereof.

Figure 2:
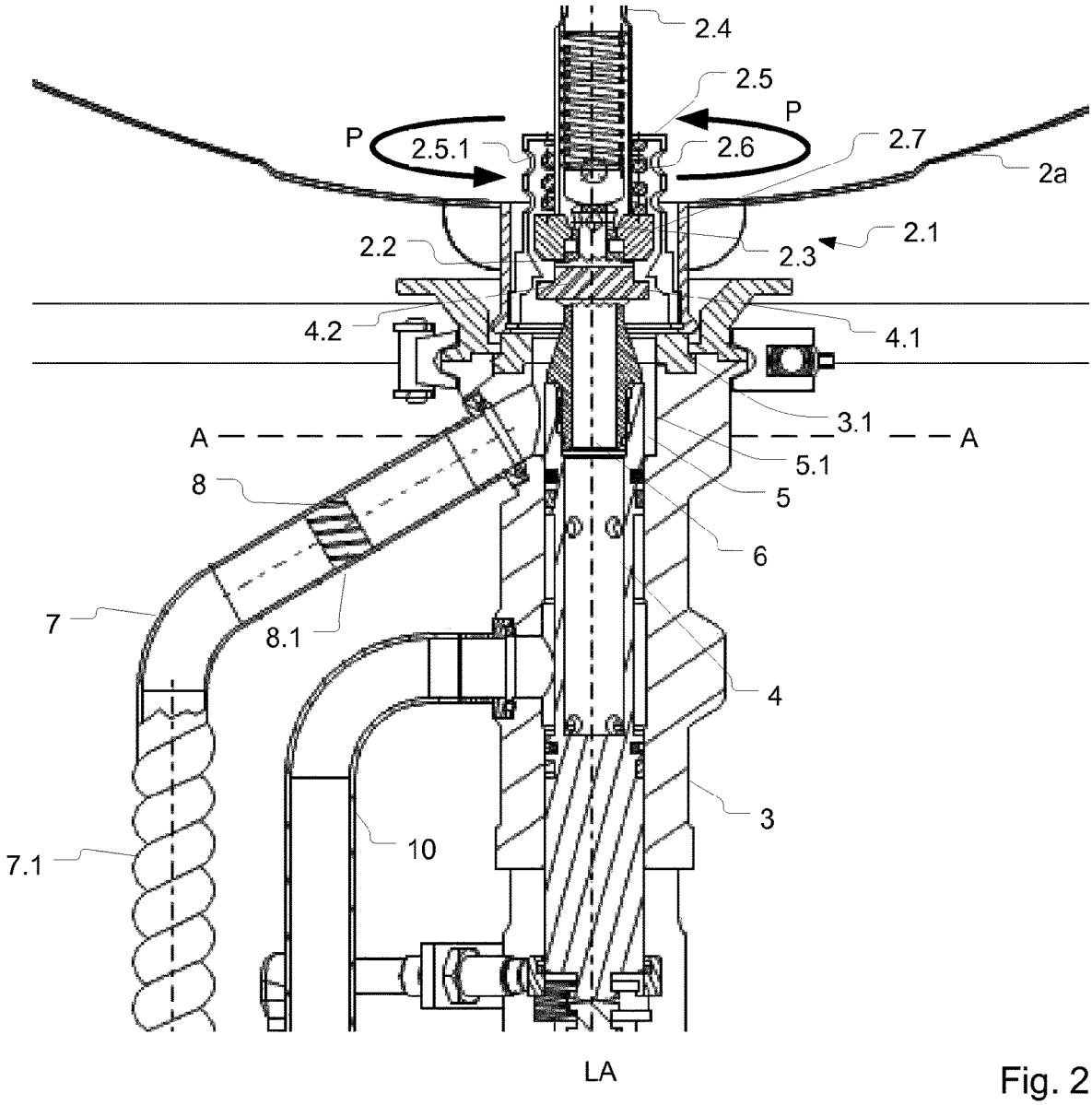
FIG. 2 shows a close-up view of the treatment head if FIG. 1.

Referring now to FIG. 2, the valve arrangement 2.1 comprises two valve bodies for opening and closing corresponding first and second fluid-passages 2.2, 2.3. The first fluid-passage 2.2 is annular. The second fluid-passage 2.3 is concentric with the first fluid-passage 2.2.

The valve arrangement 2.1 also has a tubular insertion probe 2.4 that projects from the upper container wall section 2*a* and extends deeply into the container's interior. As a result, the insertion probe 2.4 terminates with its free end separated from the lower container wall section 2*b*, by only a small gap, as shown in FIG. 1. When the valve arrangement 2.1 opens, the insertion probe 2.4 creates a fluid channel into the container's interior. Referring again to FIG. 2, this fluid channel connects to the second fluid-passage 2.3. As a result, it is possible to introduce fluid into the container 2 via the second fluid-passage 2.3 and the insertion probe 2.4.

A valve cage 2.5 surrounds the valve arrangement 2.1. Inside this valve cage 2.5 is a spring element 2.6. This spring element 2.6 pre-tensions as valve body 2.7 that is allocated to the first fluid-passage 2.2. The valve cage 2.5 also has circumferentially disposed cage-openings 2.5.1. These cage-openings 2.5.1 permit fluid that has been introduced via the first fluid-passage 2.2 to be passed into the container's interior.

A tappet 4 within the treatment head housing 3 moves relative to the treatment head housing 3 along the longitudinal axis LA. The tappet 4 has a stepped upper tappet-part 4.1. An actuator 9 positions the tappet 4 into one of two positions. In a first position, the upper tappet-part 4.1 raises the two valve bodies of the valve arrangement 2.1 out of their respective valve seats. This opens the first and second fluid-passages 2.2, 2.3. In a second position, the tappet 4 raises only the valve body allocated to the second fluid-passage 2.3. This opens only the second fluid-passage 2.3 and leaves the first fluid-passage 2.2 closed.

The treatment-head housing 3 has first and second fluid-channels 5, 6 formed, therein. The first fluid-channel 5 is an annular channel that runs in a circumferential direction around the tappet 4. The second fluid-channel 6 is an inner-bore hole within the tappet 4, and therefore extends along the longitudinal, axis LA.

The first fluid-channel 5 connects to the annular first fluid-passage 2.2 of the valve arrangement 2.1. As a result, when the first fluid-passage 2.2 opens, it permits fluid communication between the container's interior, via the first fluid-passage 2.2, and a first fluid-line 7 connected to the housing 3 by a securing flange. Fluid then flows from the first fluid-line 7 into the container's interior. Alternatively, fluid within the container's interior flows oat of the container 2 via the first fluid-line 7.

The second fluid-channel 6 likewise provides a path for introducing fluid into or discharging fluid from the container's interior. When the valve arrangement 2.1 opens, the second fluid-channel 6 connects to the second fluid-passage 2.3. The second fluid-channel 6 thus permits fluid communication between the container's interior and a second fluid-line 10. A fluid-tight coupling connects this second fluid-line 10 to the treatment-head housing 3, and in particular, to the second fluid-channel 6. As a result, fluid can be passed into or discharged from the container's interior via the second fluid-channel 6.

To more effectively clean the container's interior, it is useful to have a flow twister, or spiral-flow promoter, that promotes the generation of a spiral, or equivalently helical, fluid flow within the container 2. To achieve this, a region of the valve cage 2.5 or a region of the upper wall 2*a* located around the valve cage 2.5 has a flow twister for deflecting the direction of fluid flow, thus promoting spiral fluid flow. A flow twister can be placed in the first fluid-line 7 or in the first fluid-channel 5 itself.

Referring to FIG. 2, the first fluid-line 7 has a contoured section 7.1 having a contoured wall that functions as a flow twister. The contoured section 7.1 can be formed in any manner. In one example, the contoured section 7.1 is formed by twisting the fluid line 7. The contours themselves can follow a spiral path or an oblique path along the inner side of the fluid line wall. As an alternative, a line piece configured as a coil can be provided in the first fluid-line 7. Fluid that passes through such a coil therefore undergoes a flow twist effect that promotes spiral flow.

As an alterative or in addition, the first fluid-line 7 can include at least one twist body 8. This twist body 8 . which acts as a flow twister, can be inserted into a variety of locations. A suitable location for inserting the twist body 8 is at the inner opening of the fluid line 7. In this configuration, the twist body 8 spans the inner cross-section entirely, thus forcing all fluid in the fluid line 7 to flow through it.

in the illustrated embodiment, the twist body 8 includes plural fluid channels 8.1 that are arranged obliquely or in spiral fashion relative to the longitudinal extension of the fluid line 7. These fluid channels 8.1 change the flow direction of any fluid passing therethrough. In particular, the fluid channels 8.1 impart a spiral fluid flow or flow twist. As such, they function as a flow twister.

In other embodiments, the fluid channels 8.1 are nozzles that cause a change in direction of fluid flow.

It is also possible to place a flow twister at a location other than the first fluid-line 7. For example, it is possible to place a flow twister in the first fluid-channel 5 or in the fluid channel surrounding the tappet 4.

A suitable flow twister for promotion of spiral flow in the first fluid-channel 6 is a contoured wall 5.1 having oblique surfaces or spiral surfaces. These surfaces run obliquely relative to the undisturbed fluid flow in the first fluid-channel 5. As a result, they deflect fluid flow and thereby produce a flow twist in the flow within the first fluid-channel 5. This means that fluid's flow vector, which already has a component along the longitudinal axis LA, develops a circumferential component that runs around the tappet 4. The sum of these components thus results in a helical flow path.

The contoured wall 5.1 can be formed by forming suitable contours within the treatment head housing section that forms this wall. An alternative way to form such a wall is to form it on a sleeve and to then insert that sleeve into the first fluid-channel 5.

An additional or alternative flow twister is a tappet 4 that has had grooves or obliquely oriented surfaces formed thereon to promote the onset of spiral or helical fluid flow. These can be formed in the upper tappet-part 4.1.

In a particular embodiment, the upper tappet-part 4.1 is a plate-shaped body that has intra-tappet channels 4.2 or nozzles passing through it. These intra-tappet channels 4.2 promote spiral flow by deflecting fluid flow in the first fluid-channel 5.

The outer cross-section of the upper tappet-part 4.1 fits the cross-section of the first fluid-passage 2.2 such that the upper tappet-part 4.1 closes the first fluid-passage 2.2. This means that fluid transported in the first fluid-channel 5 has no choice but to flow through the intra-tappet channels 4.2. In this way, the upper tappet-part 4.1 promotes a rotating flow P directly in front of the valve arrangement 2.1 around the valve cage 2.5 and/or around the region of the upper container wall section 2*a* or around the valve arrangement 2.1. This is particularly advantageous for improving cleaning efficiency in the region near this valve arrangement 2.1. In particular, the shear effect resulting from this rotating flow improves cleaning.

Figure 3:
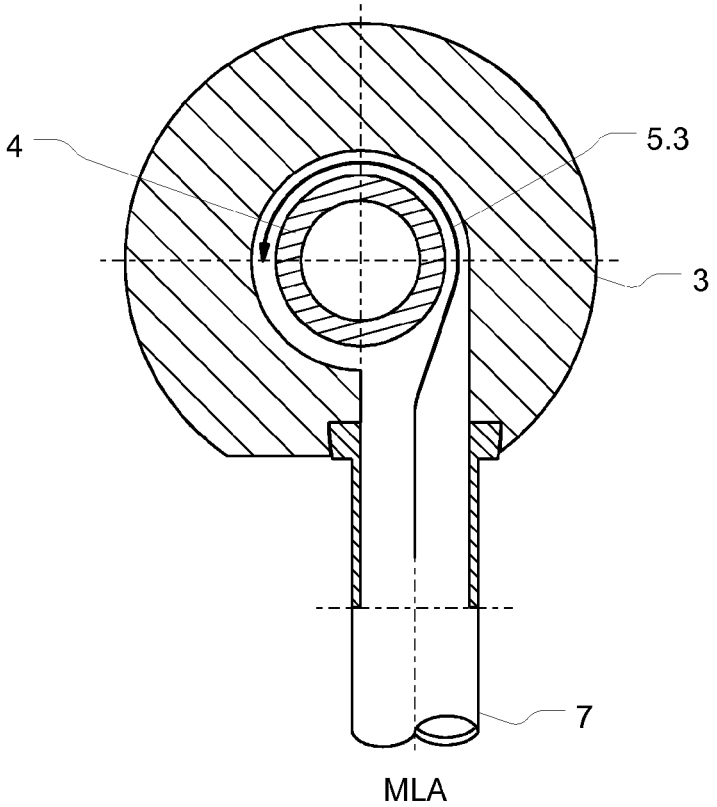
FIG. 3 shows a cross-section of a first embodiment of the treatment head shown in FIG. 2 along the sectional line A-A.
Figure 4:
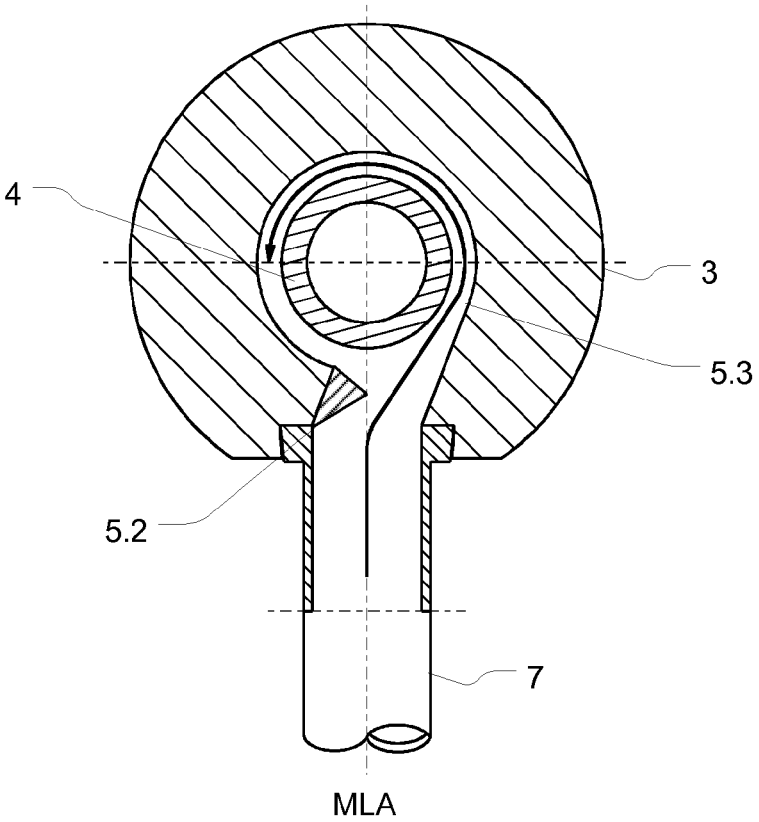
FIG. 4 shows a cross-section of a second embodiment of the treatment head shown in FIG. 2 along the sectional line A-A.

FIGS. 3 and 4 show sectional representations through the treatment head 1 along the sectional line A-A shown in FIG. 2. In FIGS. 3 and 4, it becomes possible for the first time to see an annular section 5.3 of the first fluid-channel 5 as it surrounds the tappet 4. Of particular interest in FIGS. 3 and 4 is the off-axis delivery of fluid from the first fluid-line 7 into the annular section 5.3 off-axis to promote spiral fluid flow around the tappet 4, The embodiments in FIGS. 3 and 4 achieve this result in different ways .

In the first embodiment, shown in FIG. 3, the wall of the first fluid-line 7 aligns with the center of the tappet 4, thus pushing the maximum flow vector of flow in the first fluid-line 7 off to the side. As a result, fluid from the first fluid-line 7 enters off-axis and misses the center of the tappet 4. This tends to promote circumferential flow around the tappet 4.

In the second embodiment, shown in FIG. 4, a deflector 5.2 lies at a transition region between the first fluid-line 7 and the annular section 5.3. The deflector 5.2 deflects fluid flow transported in the first fluid-line 7 so that it develops a tangential, or circumferential component. Again, the main flow vector of the first fluid-line 7 will miss the center of the tappet 4 and will, instead, be directed off to one side. This will tend to promote spiral fluid flow.

The cleaning of the container interior in the region of the upper container wall section 2*a* around the valve arrangement 2.1 can in be an additional method step while cleaning the container's interior. For example, it can be carried out as an additional, step during interval cleaning.

The cleaning process includes a short intermediate step that includes at least one additional, flushing through the first fluid-passage 2.2 to promote spiral flow around the valve cage 2.5. In some practices, this intermediate step lasts from two to six seconds during which fluid moving at high speed enters the upside-down and emptied container 2 through the first fluid-passage 2.2. This lasts just long enough to fill, the container 2 to a depth of no more than about ten centimeters above the valve arrangement 2.1. It is particularly advantageous to drain this liquid and repeat the step. This exposes the container wall to further shear while avoiding an excessively high fluid level within the container 2.

For example, the delivery via the first fluid-passage 2.2 can take place as an intermediate step within an interval cleaning in which a cleaning fluid is introduced intermittently or cyclically via the insertion probe 2.4 into the container interior. For example, with interval cleaning, the volume flow introduced to the container interior can differ in sequential pulse cycles; specifically, in a first cycle interval, the introduction of the cleaning fluid can take place with a very high volume flow, such that a spraying effect of the lower container wall section 2*b* takes place with a wall-adhering fluid flow, which leads to good shear effects at this lower container wall section 2*b* or, respectively, parts adjacent to this lower container wall section 2*b*. In a following further cycle step, cleaning fluid can then be introduced with a reduced volume flow, such that the cleaning fluid runs down directly on the outside, at the wall of the insertion probe 2.4, and cleans this. By means of this inherently known interval cleaning, however, only an inadequate cleaning of the container interior can be achieved in the region of the upper container wall section 2*a,* in particular in the region around the valve cage 2.5. Due to the additional cleaning step, in which a cleaning fluid is delivered through the first fluid-passage 2.2 into the container interior in such a way that a flow rotation around the valve cage 2.5 is incurred, an optimized cleaning of the container wall in the region around the valve cage 2.5 takes place. Preferably, with interval cleaning, with which the introduction of the cleaning fluid takes place via the insertion probe 2.4, the first fluid-channel is used as a run-back for: the cleaning fluid, such that, during the interval cleaning, preferably a complete emptying of the container interior takes place via the first fluid-passage 2.2 or, respectively, the first fluid-channel connecting to it. In a renewed introduction of a cleaning fluid which then follows, via the first fluid-passage 2.2, and a flow rotation caused by this around the valve cage 2.5, due to the complete emptying of the container in the preceding interval cleaning cycle an optimum shear effect is achieved, and therefore an optimum cleaning effect at the upper container wall section 2*a* and at the valve cage 2.5 respectively.

By way of example, a cleaning cycle is described hereinafter by means of which a container 2 is cleaned, making use of a cleaning step in which cleaning fluid is delivered to the container 2 via the first fluid-passage 2.2, referred to hereinafter as annular channel rotation flushing. First, for example, an emptying of the residue from the container 2 can be carried out, then a mixed water flushing, for example by way of the interval cleaning described heretofore, and then a flushing with a first alkali, for example likewise with the interval cleaning described heretofore. Next, an annular channel rotation flushing according to the invention can take place by means of an alkali, wherein preferably no counter-pressure predominates in the container. This can be achieved, for example, in that, by way of the insertion probe 2.4 and the second fluid-channel 6, the gas displaced by the introduction of the fluid can escape from the container interior. After the ending of the annular channel rotation flushing, an interval cleaning can preferably take place. Preferably, the interval cleaning begins with a method step of insertion probe flooding, i.e. a delivery of the cleaning fluid with a low volume flow, such that the cleaning fluid runs downwards over the wall of the insertion probe 2.4. The advantage of beginning the interval cleaning with insertion probe flooding lies in the fact that, via the first fluid-passage 2.2 or the first fluid-channel 5 respectively, any cleaning fluid present in the container 2 can be appropriately discharged, such that the smallest quantity possible of standing cleaning fluid is present in the container which could impede the cleaning performance.

Next, in a further cycle, a further annular channel rotation flushing step can be carried out. This can serve in particular for the container to be partially filled with cleaning fluid. This part filling can take place in particular with a cleaning fluid which is used for a softening step following the annular channel rotation flushing.

After the carrying out of a softening step, a flushing of the container interior with an alkali can then take place in turn, which can take place by means of an interval cleaning or, depending on the cleaning intensity necessary, a further annular channel rotation flushing step can additionally also be carried out. After the alkali flushing, an interval cleaning with an acid can then take place, wherein, alternating, an annular channel rotation flushing, likewise with an acid, can be provided for. With products with a higher cementation portion, the cycle time can be lengthened accordingly.

After the acid treatment by the interval cleaning or annular channel rotation flushing, a hot water clear flushing step can then take place. Finally, the container interior can be sterilized, for example by application of steam.

The invention has been described heretofore by way of exemplary embodiments. It is understood that many alterations or deviations are possible without thereby departing from the inventive concept on which the invention is based.

The invention claimed is:

1. An apparatus comprising a treatment head for cleaning a container that has a valve arrangement, wherein said treatment head comprises a tappet, a housing, a first fluid-channel, an annular fluid-channel section, a second fluid-channel, and a flow twister, wherein said tappet is configured to move relative to said housing to open said valve arrangement, wherein said first fluid-channel comprises said annular fluid channel section, wherein said first fluid-channel circumferentially surrounds said second fluid-channel, wherein said first and second fluid-channels provide fluid communication into said container, and wherein said flow twister is disposed in a location selected from the group consisting of said first fluid-channel and a fluid line connected to said first fluid-channel.

2. The apparatus of claim 1, wherein said flow twister comprises a twist body, wherein said twist body is disposed at said location, wherein said twist body comprises fluid channels, and wherein said fluid channels run obliquely to a flow direction leading to said location.

3. The apparatus of claim 1, wherein said flow twister comprises a fluid line leading into said housing, said fluid line having a contoured wall.

4. The apparatus of claim 1, wherein said flow twister comprises contoured walls of said first fluid-channel.

5. The apparatus of claim 1, wherein said flow twister comprises a grooved wall of said first fluid-channel, wherein grooves of said grooved wall extend obliquely relative to a flow direction leading to said location.

6. The apparatus of claim 1, wherein said first fluid-channel has a central axis and wherein fluid that enters said first fluid-channel does so along an off-center direction that misses said central axis.

7. The apparatus of claim 1, further comprising a deflector, wherein said deflector is disposed to divert fluid flow into said first fluid-channel so that said fluid enters along an off-center direction that misses a central axis of said first fluid-channel.

8. The apparatus of claim 1, wherein said valve arrangement comprises an annular passage, wherein when said container is arranged at said treatment head, said first fluid-channel connects to said annular passage.

9. The apparatus of claim 1, further comprising a container-treatment machine, wherein said container-treatment machine comprises said treatment head.

10. A method comprising cleaning a container that comprises a valve arrangement, wherein cleaning said container comprises using a treatment head that has a tappet, a housing, a first fluid-channel, an annular fluid-channel section, a second fluid-channel, and a flow twister, wherein said tappet is configured to move relative to said housing to open said valve arrangement, wherein said first fluid-channel comprises said annular fluid channel section, wherein said first fluid-channel circumferentially surrounds said second fluid-channel, wherein said first and second fluid-channels provide fluid communication into said container, and wherein said flow twister is disposed in a location selected from the group consisting of said first fluid-channel and a fluid line connected to said first fluid-channel, said method comprising causing fluid that is supplied into said container via said first fluid-channel to be set into one of a spiral and helical fluid flow at a location selected from the group consisting of said first fluid-channel and a line connected to said first fluid-channel, and, after said spiral or helical fluid flow enters said container, producing a flow swirl around said valve arrangement.

11. The apparatus of claim 1, wherein said tappet comprises obliquely oriented surfaces formed thereon.

12. The apparatus of claim 1, wherein said annular fluid-channel section surrounds said tappet and wherein a fluid line that directs fluid into said annular section has a longitudinal axis that fails to intersect a central axis of said first fluid channel.

13. The apparatus of claim 1, further comprising a deflector that causes flow that is directed toward a central axis of said first fluid channel to veer away from said central axis.

14. The apparatus of claim 1, wherein said flow twister comprises obliquely running fluid channels that run through an upper tappet-part of said tappet comprises an upper tapper-part that contacts said valve arrangement.

15. The apparatus of claim 1, wherein said flow twister is disposed in said first fluid-channel.

16. The apparatus of claim 1, wherein said flow twister is disposed in said fluid line connected to said first fluid-channel.

17. The apparatus of claim 1, wherein said tappet comprises an upper tapper-part that contacts said valve arrangement and wherein said flow twister comprises fluid channels running through said upper tappet-part in a spiral direction.

18. The apparatus of claim 1, wherein said tappet comprises grooves formed thereon.

19. The apparatus of claim 1, wherein said flow twister is configured to cause flow that has a straight-line component and a further component that is transverse to said straight-line component.

* * * * *